US009575438B2

(12) United States Patent
Takai et al.

(10) Patent No.: US 9,575,438 B2
(45) Date of Patent: Feb. 21, 2017

(54) IMAGE FORMING DEVICE

(71) Applicant: Konica Minolta, Inc., Chiyoda-ku, Tokyo (JP)

(72) Inventors: Takayuki Takai, Anjo (JP); Takuya Okada, Toyokawa (JP); Takashi Kawanago, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/808,044

(22) Filed: Jul. 24, 2015

(65) Prior Publication Data

US 2016/0026146 A1 Jan. 28, 2016

(30) Foreign Application Priority Data

Jul. 28, 2014 (JP) ..... 2014-153002

(51) Int. Cl.
*G03G 21/00* (2006.01)
*G03G 15/16* (2006.01)

(52) U.S. Cl.
CPC ..... *G03G 15/161* (2013.01); *G03G 21/0029* (2013.01); *G03G 21/0076* (2013.01); *G03G 2215/0132* (2013.01)

(58) Field of Classification Search
CPC ..... G03G 15/161; G03G 21/0029; G03G 15/0882; G03G 2215/0119; G03G 21/0017; G03G 15/0131; G03G 9/0819; G03G 9/0821; G03G 9/0827; G03G 15/0874; G03G 15/1615; G03G 15/168; G03G 15/751
See application file for complete search history.

(56) References Cited

U.S. PATENT DOCUMENTS 6,815,134 B2 * 11/2004 Kyung ..... G03G 5/144 399/159
2002/0110748 A1 * 8/2002 Oshiba ..... G03G 9/0819 430/125.1
2009/0297972 A1 * 12/2009 Sakimura ..... G03G 5/14704 430/66
2011/0091255 A1 * 4/2011 Thayer ..... G03G 21/0011 399/350
2011/0116829 A1 5/2011 Takayanagi

FOREIGN PATENT DOCUMENTS

JP 2-78974 U 6/1990
JP 6-230709 A 8/1994
(Continued)

OTHER PUBLICATIONS

Office Action (Notice of Reasons for Rejection) drafted Sep. 16, 2016 issued by the Japanese Patent Office in corresponding Japanese Patent Application No. 2014-153002, and English language translation of Office Action (10 pages).

*Primary Examiner* — Roy Y Yi
(74) *Attorney, Agent, or Firm* — Buchanan Ingersoll & Rooney PC

(57) ABSTRACT

An image forming device includes: an image carrier on which a toner image is formed; and a cleaning blade which removes a residual material on the image carrier after the toner image is transferred to a transferred body, wherein the image carrier includes an elastic layer, the cleaning blade is a metallic plate spring, and a tip end of the cleaning blade is pressed against the image carrier by restoring force of the plate spring.

11 Claims, 6 Drawing Sheets

(56) References Cited

FOREIGN PATENT DOCUMENTS

| | | | |
|---|---|---|---|
| JP | 7-104626 | A | 4/1995 |
| JP | 11-109817 | A | 4/1999 |
| JP | 2002-311766 | A | 10/2002 |
| JP | 2003-112129 | A | 4/2003 |
| JP | 2004-271603 | A | 9/2004 |
| JP | 2005-274952 | A | 10/2005 |
| JP | 2010-145656 | A | 7/2010 |
| JP | 2011-107534 | A | 6/2011 |

* cited by examiner

| | | 35N | 45N | 55N | 65N |
|---|---|---|---|---|---|
| 1 | METALLIC BLADE FIXATION | 0 | 0 | 1 (INTERMITTENTLY UNWIPED) | 3 (INTERMITTENTLY UNWIPED) |
| 2 | METALLIC BLADE NON-FIXATION | 0 | 0 | 0 | 0 |

IMAGE FORMING DEVICE

The entire disclosure of Japanese Patent Application No. 2014-153002 filed on Jul. 28, 2014 including description, claims, drawings, and abstract are incorporated herein by reference in its entirety.

BACKGROUND OF THE INVENTION

Field of the Invention

The present invention relates to an image forming device which transfers a toner image formed on an image carrier to a transferred body and removing a residual material on the image carrier after the transfer by means of a cleaning blade.

Description of the Related Art

An image forming device such as an electrophotographic printer includes an intermediate transfer system which forms toner images of respective colors of Y (yellow), M (magenta), C (cyan) and K (black) on respective photoreceptor drums and overlaps the toner images of Y to K colors formed on the respective photoreceptor drums with a rotating intermediate transfer belt to primarily transfer, then secondarily transfers the toner images of the respective colors multi-transferred to the intermediate transfer belt to a recording sheet, for example.

A belt formed of a resin material such as PI (polyimide) and PPS (polyphenylenesulfide) is generally widely adopted as such intermediate transfer belt, but there is a case in which adhesiveness in a secondary transfer position between the intermediate transfer belt and the recording sheet is deteriorated due to difference in macroscopic unevenness of a surface shape among paper types to be used (for example, normal paper, thin coated paper, thick paper and the like) and it becomes difficult to secure a transfer property.

In order to prevent such deterioration in the transfer property, there is a configuration in which an elastic layer made of a rubber material and the like is provided on a base layer made of the resin material on the intermediate transfer belt to make a surface shape of the intermediate transfer belt deformable to fit a surface shape of the recording sheet by the elastic layer, such that the adhesiveness between the intermediate transfer belt and the recording sheet is improved.

When the toner image on the intermediate transfer belt is transferred to the recording sheet, all the toner images are ideally transferred to the recording sheet; however, there actually is a case in which a part of toner particles remains on the intermediate transfer belt without being transferred. There also is a case in which paper powder adheres to the intermediate transfer belt by contact with the recording sheet. If such a residual material such as the remained toner and paper powder remains adhering to the intermediate transfer belt, this causes a trouble in subsequent formation of the toner image, so that a cleaner which removes the residual material on the intermediate transfer belt is provided.

As the above-described cleaner, a configuration of allowing a tip end of the cleaning blade made of an elastic body such as urethane rubber to abut a rotating intermediate transfer belt and scrapping the residual material on the intermediate transfer belt to remove is common.

In a configuration in which the cleaning blade formed of the elastic body abuts the intermediate transfer belt including the elastic layer, a real contact area becomes larger by abutment between the elastic bodies and frictional force generated between contacting portions becomes significantly large. Therefore, abrasion of the cleaning blade or the intermediate transfer belt is promoted and a lifetime becomes problematically short.

When hardness of the elastic body such as urethane rubber being a material of the cleaning blade changes by change in peripheral temperature, for example, a contact area between the intermediate transfer belt and the cleaning blade varies and the frictional force between the intermediate transfer belt and the cleaning blade also varies. The frictional force acts as brake to the rotating intermediate transfer belt, so that a rotational speed of the intermediate transfer belt varies due to increased variation in the frictional force, that is to say, brake force and peripheral speed difference occurs between the same and each photoreceptor drum rotating at a certain speed.

When the peripheral speed difference between the intermediate transfer belt and each photoreceptor drum occurs, positions of the toner images of respective colors transferred to the intermediate transfer belt easily displace to each other in a rotational direction when the toner images of respective colors are multi-transferred from the photoreceptor drums to the intermediate transfer belt. This displacement is problematic because color shift occurs when a color image is formed.

The above-described problem is not limited to the configuration of transferring the toner image on the intermediate transfer belt to the recording sheet. For example, this might generally occur in a configuration of transferring the toner image on an image carrier to a transferred body such as a configuration of transferring the toner image formed on a photoreceptor belt to an intermediate transfer drum.

SUMMARY OF THE INVENTION

The present invention has been made in view of the above-described problems and an object thereof is to provide an image forming device capable of inhibiting deterioration in lifetime of a cleaning blade and an image carrier and inhibiting color shift when a color image is formed in a configuration of removing a residual material on the image carrier such as an intermediate transfer belt including an elastic layer by a cleaning blade.

To achieve the abovementioned object, according to an aspect, an image forming device reflecting one aspect of the present invention is an image forming device which transfers a toner image formed on an image carrier to a transferred body and removes a residual material on the image carrier after the transfer by means of a cleaning blade, the image carrier includes an elastic layer, the cleaning blade is a metallic plate spring, and a tip end of the cleaning blade is pressed against the image carrier by restoring force of the plate spring.

Herein, the image forming device desirably includes a supporting member which supports the cleaning blade in a state with play with respect to the image carrier.

Furthermore, the image forming device desirably includes an energizing member which applies force in a direction to press the cleaning blade against the image carrier to the supporting member.

Abutting pressure of the cleaning blade to the image carrier is desirably set such that a biting amount of the tip end of the cleaning blade into a surface of the image carrier becomes a predetermined value.

Herein, the predetermined value is desirably a value determined in advance as a value not smaller than surface roughness of the image carrier.

The cleaning blade is desirably arranged such that the tip end is in a counter direction relative to a moving direction of the image carrier, an end face of the tip end is desirably a flat surface, and an angle between the end face of the tip end of the cleaning blade and a surface portion of the image carrier is desirably a right angle or an angle within an allowable range from the right angle.

Furthermore, the cleaning blade is desirably elongated in a width direction orthogonal to the moving direction of the image carrier and corner portions on both ends in the width direction on the tip end are desirably formed to have an R shape.

The image carrier desirably further includes abase layer and a surface layer which the cleaning blade abuts arranged on a side opposite to the base layer across the elastic layer, and the surface layer is desirably formed of a material with higher hardness than that of the elastic layer.

Furthermore, the image forming device desirably includes an image forming unit which forms toner images of different colors on each of a plurality of photoreceptors and an intermediate transfer body to which the toner images of respective colors formed on the plurality of photoreceptors are multi-transferred, the image carrier is desirably the intermediate transfer body, and the transferred body is desirably a recording sheet to which the toner images of respective colors multi-transferred to the intermediate transfer body is transferred.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

An embodiment of an image forming device according to the present invention is hereinafter described by taking a tandem color printer (hereinafter, simply referred to as "printer") as an example.

(1) Entire Configuration of Printer

Figure 1:
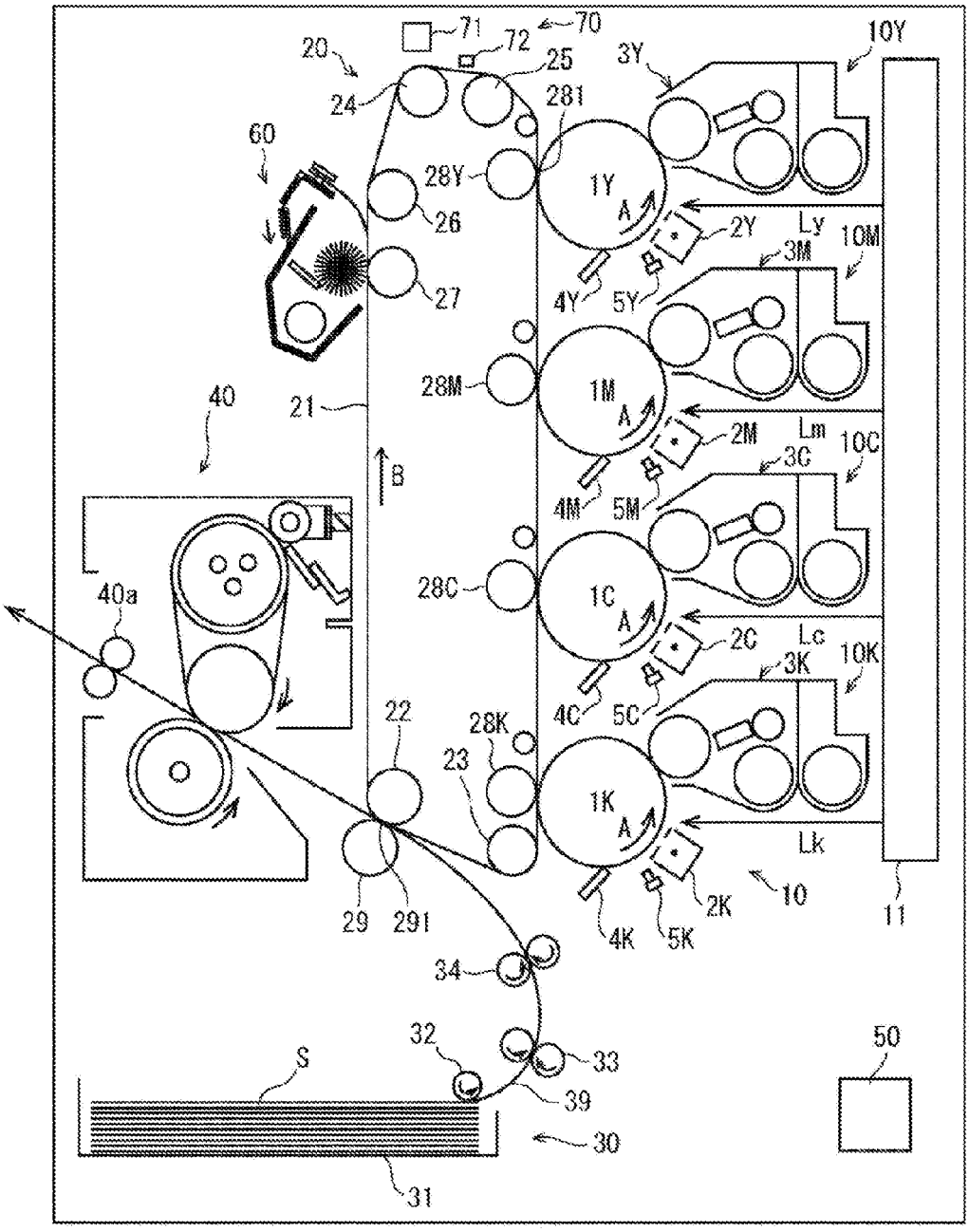
FIG. 1 is a view illustrating an entire configuration of a printer.

FIG. 1 is a view illustrating an entire configuration of the printer.

As illustrated in the drawing, the printer configured to form an image by a well-known electrophotographic system provided with an image forming unit 10, an intermediate transfer unit 20, a feeder 30, a fixing unit 40, a controller 50, a belt cleaning unit 60, a steering unit 70 and the like is connected to a network (LAN, for example), and when receiving an instruction to execute a print job from an external terminal device (not illustrated), this forms a color image of yellow, magenta, cyan, and black based on the instruction. Hereinafter, reproductive colors of yellow, magenta, cyan, and black are represented as Y, M, C, and K, respectively, and Y, M, C, and K are added as subscripts to a number representing a component related to each reproductive color.

The image forming unit 10 is provided with image forming units 10Y, 10M, 10C, and 10K corresponding to colors of Y to K, respectively, and an exposure unit 11.

The image forming units 10Y to 10K provided with photoreceptor drums 1Y, 1M, 1C, and 1K rotating in a direction indicated by an arrow A, charging units 2Y, 2M, 2C, and 2K, developing units 3Y, 3M, 3C, and 3K, drum cleaning units 4Y, 4M, 4C, and 4K, and neutralizing units 5Y, 5M, 5C, and 5K, respectively, arranged around them in the drum rotating direction A, form toner images of colors corresponding to the photoreceptor drums 1Y to 1K, respectively.

The intermediate transfer unit 20 is provided with an intermediate transfer belt 21, a driving roller 22, driven rollers 23 to 27, primary transfer rollers 28Y, 28M, 28C, and 28K arranged so as to be opposed to the photoreceptor drums 1Y, 1M, 1C, and 1K, respectively, with the intermediate transfer belt 21 interposed therebetween, a secondary transfer roller 29 arranged so as to be opposed to the driving roller 22 with the intermediate transfer belt 21 interposed therebetween and the like.

The intermediate transfer belt 21 being an elastic belt including an elastic layer is stretched by means of the driving roller 22, the driven rollers 23 to 27 and the like and circulatingly travels in a direction indicated by an arrow B (belt travel direction) by rotary driving force of the driving roller 22. The driving roller 22 is rotary driven by a motor not illustrated.

The feeder 30 is provided with a paper feeding cassette 31, a delivery roller 32, a conveying roller pair 33, a timing roller pair 34 and the like.

The paper feeding cassette 31 stores paper S as a recording sheet. The delivery roller 32 delivers the paper S stored in the paper feeding cassette 31 one by one to a conveyance path 39.

The conveying roller pair 33 further conveys the delivered paper S on the conveyance path 39 downstream in a conveying direction. The timing roller pair 34 controls timing to send the conveyed paper S to a secondary transfer position 291 being a contact position of the secondary transfer roller 29 and the intermediate transfer belt 21.

The fixing unit 40 secures fixing nip by pressure welding of a fixing roller and a pressurizing roller and heats the fixing roller by using a heater to maintain temperature required for fixing.

The belt cleaning unit 60 is arranged in a space around the intermediate transfer belt 21 between the secondary transfer position 291 and a primary transfer position 281 of the photoreceptor drum 1Y (position in which the photoreceptor drum 1Y opposes to the primary transfer roller 28Y with the intermediate transfer belt 21 interposed therebetween) in the belt travel direction (arrow B direction).

The controller 50 converts an image signal from the external terminal device to image signals for Y to K colors and generates driving signals for driving laser diodes (not illustrated) for respective colors arranged on the exposure unit 11. A laser beam Ly for Y color, a laser beam Lm for M color, a laser beam Lc for C color, and a laser beam Lk for K color are emitted from the exposure unit 11 by the generated driving signals and the photoreceptor drums 1Y to 1K are exposure-scanned.

Before being exposure-scanned, the photoreceptor drums 1Y to 1K are uniformly charged by the charging units 2Y to 2K after neutralization by the neutralizing units 5Y to 5K, respectively, and electrostatic latent images are formed on peripheral surfaces of the photoreceptor drums 1Y to 1K by exposure of the laser beams Ly to Lk, respectively. The electrostatic latent images are developed with toner by a developing agent stored in the developing units 3Y to 3K. The toner images of Y to K colors formed on the photoreceptor drums 1Y to 1K by the development are primarily transferred to the intermediate transfer belt 21 by electrostatic force acting between the primary transfer rollers 28Y to 28K and the photoreceptor drums 1Y to 1K, respectively.

Image forming operation of each color on the photoreceptor drums 1Y to 1K is executed at different timings such that the toner images are transferred in the same position on the intermediate transfer belt 21 in an overlapping manner. The toner images of respective colors multi-transferred to the intermediate transfer belt 21 move to the secondary transfer position 291 by circulating travel of the intermediate transfer belt 21.

Along with the timing of the above-described image forming operation, the paper S is fed from the paper feeder 30 through the timing roller pair 34, the paper S is conveyed in a manner interposed between the secondary transfer roller 29 and the intermediate transfer belt 21, and the toner images of respective colors on the intermediate transfer belt 21 are secondarily transferred to the paper S in block in the secondary transfer position 291 by electrostatic force acting between the secondary transfer roller 29 and the intermediate transfer belt 21.

The paper S which passes through the secondary transfer position 291 is conveyed to the fixing unit 40, and when this passes through the fixing nip, the toner images are heated and pressurized to be fixed to the paper S, and this is discharged outside through a discharging roller pair 40*a*.

Out of the toner images on the photoreceptor drums 1Y to 1K, a residual material including the toner remained on the photoreceptor drums 1Y to 1K without being primarily transferred to the intermediate transfer belt 21 and paper powder is removed by the drum cleaning units 4Y to 4K.

Out of the toner images on the intermediate transfer belt 21, the residual material including the toner remained on the intermediate transfer belt 21 without being secondarily transferred to the paper S and the paper powder is removed by the belt cleaning unit 60.

(2) Configuration of Belt Cleaning Unit

Figure 2:
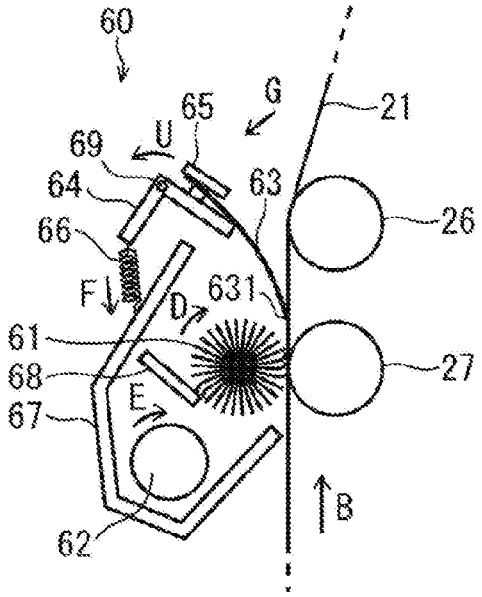
FIG. 2 is an enlarged view of a configuration of a belt cleaning unit.

FIG. 2 is an enlarged view of a configuration of the belt cleaning unit 60 in which other members such as the intermediate transfer belt 21 and the driven rollers 26 and 27 around the same are also illustrated.

As illustrated in this drawing, the belt cleaning unit 60 is provided with a cleaning roller 61, a conveying screw 62, a cleaning blade 63, a blade supporting member 64, a blade supporting pin 65, an extension spring 66, a housing 67, a flicker 68 and the like.

Herein, the cleaning roller 61, the conveying screw 62, the cleaning blade 63, the blade supporting member 64, the housing 67, and the flicker 68 are elongated in a width direction of the intermediate transfer belt 21 (direction perpendicular to a surface of the drawing: direction orthogonal to the belt travel direction B). The above-described width direction of the intermediate transfer belt 21 is hereinafter referred to as a belt width direction W.

The housing 67 made of insulating resin and the like stores the cleaning roller 61, the conveying screw 62, and the flicker 68 inside thereof, and has an opening on a side opposed to the intermediate transfer belt 21.

The cleaning roller 61 provided on the opening of the housing 67 is formed of any one of a brush roller obtained by implanting brush fibers on an outer periphery of core metal and a foamed roller obtained by forming foamed urethane, rotates in a direction indicated by an arrow D, and scraps a part of the residual material on the intermediate transfer belt 21 when a roller tip end rubs a surface of the intermediate transfer belt 21 to remove the same from the intermediate transfer belt 21. Meanwhile, it is also possible to configure to apply voltage of polarity opposite to the polarity of the residual toner on the intermediate transfer belt 21 to the cleaning roller 61 to generate an electric field in which electrostatic force in a direction from the intermediate transfer belt 21 toward the cleaning roller 61 acts on the residual toner.

The flicker 68 being a thin plate-shaped member abuts a surface of the cleaning roller 61 to scrap the residual material held on the roller. The scraped residual material drops downward by gravity.

The conveying screw 62 arranged in a position just below the flicker 68 rotates in a direction indicated by an arrow E and conveys the residual material scrapped from the cleaning roller 61 by the flicker 68 on one end side in the belt width direction W to store in a recovery tank not illustrated. Meanwhile, the cleaning roller 61 and the conveying screw 62 are rotary-driven by a motor not illustrated.

The cleaning blade 63 arranged downstream of the cleaning roller 61 in the belt travel direction is obtained by forming a metallic thin plate into a plate spring and a tip end 631 thereof abuts the surface of the intermediate transfer belt 21 in an attitude facing a direction opposite to the belt travel direction B (counter direction) and scraps a remaining residual material which cannot be removed by the cleaning roller 61 on the intermediate transfer belt 21 to remove from the intermediate transfer belt 21. After the scraped residual material drops, this is conveyed to the conveying screw 62 through the cleaning roller 61.

In this embodiment, ability of removing the residual material on the intermediate transfer belt 21 of the cleaning blade 63 is higher than that of the cleaning roller 61 and it is configured that the cleaning roller 61 plays a supplementary role of the cleaning blade 63.

The cleaning roller 61 also plays a role in removing an adhered material which might get stuck in a cleaning portion (contact portion with the surface of the intermediate transfer belt 21) of the cleaning blade 63 to cause cleaning trouble such as fibrous paper powder adhered to the intermediate transfer belt 21 and this is desirably located upstream of the cleaning blade 63 in the belt travel direction B.

The cleaning blade 63 is supported on the blade supporting member 64 by the blade supporting pin 65. A supporting mechanism of the cleaning blade 63 is illustrated with reference to FIGS. 3 and 4.

Figure 3:
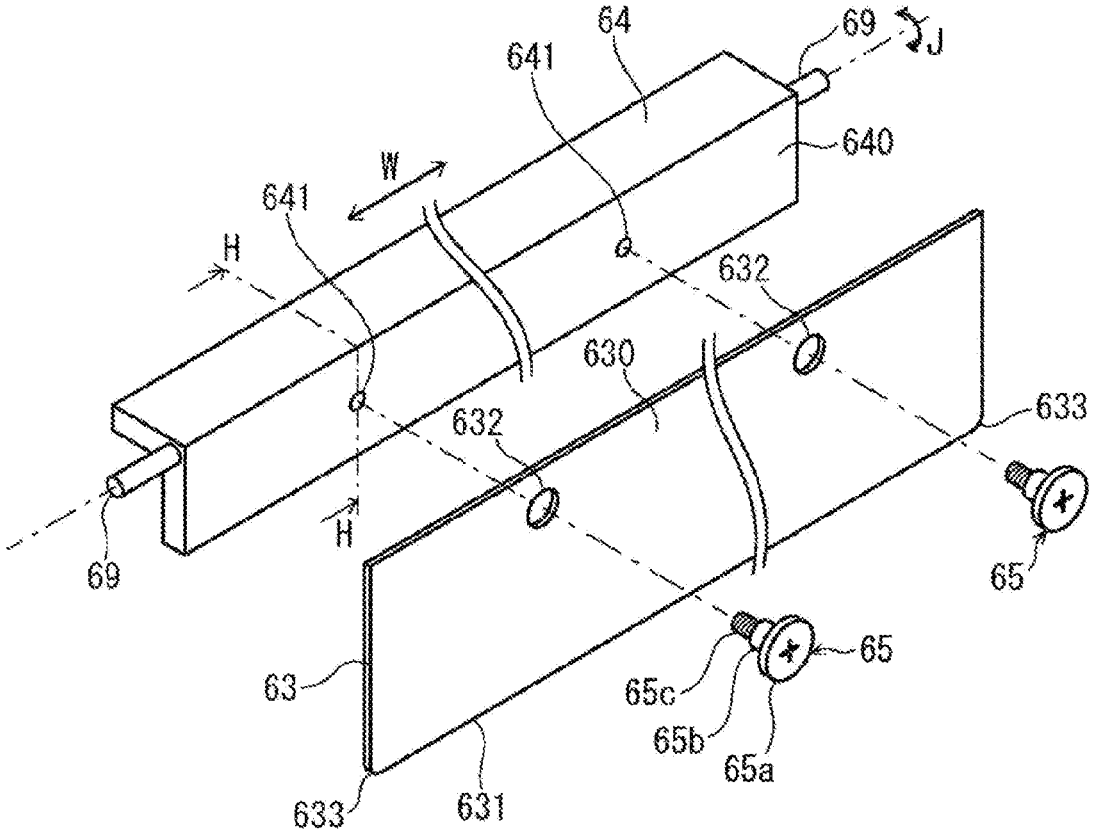
FIG. 3 is an exploded perspective view of a cleaning blade, a blade supporting member, and a blade supporting pin.
Figure 4:
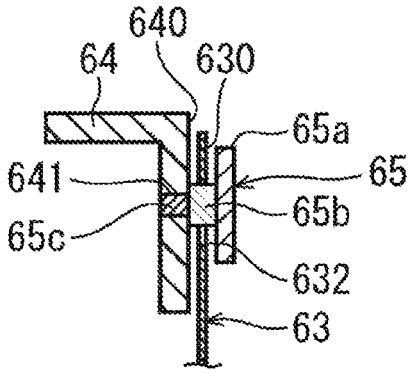
FIG. 4 is a cross-sectional view taken along line H-H in FIG. 3 in a state in which the cleaning blade is supported on the blade supporting member.

FIG. 3 is an exploded perspective view of the cleaning blade 63, the blade supporting member 64, and the blade supporting pin 65 as seen in a direction indicated by an arrow G in FIG. 2. FIG. 4 is a cross-sectional view taken along line H-H in FIG. 3 in a state in which the cleaning blade 63 is supported on the blade supporting member 64 by the blade supporting pin 65.

As illustrated in FIG. 3, the cleaning blade 63 is a rectangular metallic thin plate elongated in the belt width direction W and a metallic material is high corrosion resistance stainless steel, brass and the like, for example. Although the metallic material is not limited thereto, high-strength stainless steel with less fatigue is especially desirable. Furthermore, it is also possible to plate the surface of the cleaning blade 63 with hard chrome or nickel in order to inhibit abrasion thereof by polishing by a toner external additive and the like for improving a lifetime of the cleaning blade 63.

A thickness of the cleaning blade 63 may be set within a range of approximately 0.06 to 0.1 mm, for example, but the thickness is not limited to this. It is sufficient that the cleaning blade 63 bends to a certain degree in a state in which the tip end (one side) 631 of the cleaning blade 63 abuts the intermediate transfer belt 21 such that adhesiveness to the surface of the intermediate transfer belt 21 is secured.

Through holes 632 are provided in positions at a regular interval in the belt width direction W on a base end 630 on a side opposite to the tip end 631 of the cleaning blade 63.

The blade supporting member 64 being a plate-shaped member elongated in the belt width direction W has a cross-sectional surface bending in an L shape in which a plurality of screw holes 641 corresponding to a plurality of through holes 632 provided on the cleaning blade 63 is provided on a surface 640 on a side opposed to the cleaning blade 63.

The blade supporting pin 65 includes a head portion 65*a*, a shank 65*b* having a diameter smaller than that of the head portion 65*a*, and a screw portion 65*c*. Herein, when diameters of the head portion 65*a* and the shank 65*b*, a length (height from the head portion 65*a*) of the shank 65*b*, a diameter of the through hole 632 of the cleaning blade 63, and a thickness of the cleaning blade 63 are set to d1, d2, d3, d4, and d5, respectively, relationships of $d2<d4<d1$ and $d5<d3$ are satisfied.

The screw portion 65*c* of each blade supporting pin 65 is screwed into the screw hole 641 of the blade supporting member 64 in a state in which the shank 65*b* thereof is inserted into the through hole 632 of the cleaning blade 63, so that the cleaning blade 63 is supported on the blade supporting member 64.

As illustrated in FIG. 4, when the screw portion 65*c* of the blade supporting pin 65 is screwed into the screw hole 641 of the blade supporting member 64, the cleaning blade 63 is supported on the blade supporting member 64 with a backlash according to the above-described relationships of $d2<d4$ and $d5<d3$. That is to say, the cleaning blade 63 is not completely fixed to the blade supporting member 64 and is held with freedom.

A degree of the backlash of the cleaning blade 63 is determined by difference between d2 and d4 and difference between d5 and d3, and the backlash corresponds to play of the cleaning blade 63 with respect to the blade supporting member 64. Such predetermined play is provided for a following reason.

That is to say, force in the belt travel direction B acts on the tip end 631 of the cleaning blade 63 by frictional force between the same and the surface of the circulating intermediate transfer belt 21. If the base end 630 of the cleaning blade 63 is completely fixed to be supported on the blade supporting member 64 without the play, the cleaning blade 63 cannot allow almost whole the force to escape.

Specifically, in a case in which deviation of abutting pressure distribution (biased load) occurs such that abutting pressure to the surface of the intermediate transfer belt 21 becomes larger on one end side in the belt width direction Wand smaller on the other end by flapping (to be described later) occurring on the intermediate transfer belt 21, for example, it is not possible to allow larger pressure to escape for eliminating the deviation with fixed supporting. Therefore, the abutting pressure of the tip end 631 of the cleaning blade 63 to the surface of the intermediate transfer belt 21 becomes larger than that before the flapping occurs on one end side in the belt width direction W, and if this state continues, the abrasion of the surface of the intermediate transfer belt 21 might easily progress rapidly.

On the other hand, when the base end 630 of the cleaning blade 63 is freely supported on the blade supporting member 64 with the play, the cleaning blade 63 may freely displace within a range of the play, the larger pressure due to the above-described deviation of the abutting pressure distribution is allowed to escape by an amount of the play, so that the abutting pressure is prevented from becoming too large on one end side in the belt width direction W and the progress of the abrasion of the surface of the intermediate transfer belt 21 may be inhibited.

Meanwhile, a method of supporting the cleaning blade 63 on the blade supporting member 64 with the play is not limited to the method of using the blade supporting pin 65 and another method may also be used. For example, there might be a configuration in which a projection having a diameter smaller than that of the through hole 632 of the cleaning blade 63 is provided on the blade supporting member 64 in place of the screw hole 641 of the blade supporting member 64 and retention is provided on the projection such that the cleaning blade 63 does not escape from a tip end of the projection in a state in which the projection is fit into the through hole 632 of the cleaning blade 63 and the like.

With reference to FIG. 3 again, an R shape is provided on a corner portion 633 on each of both ends in the belt width direction W of the tip end 631 of the cleaning blade 63. The corner portion of the cleaning blade 63 is rounded as the R shape in order to prevent the corner portion 633 of the tip end 631 of the cleaning blade 63 from sticking into the surface of the intermediate transfer belt 21. A size (radius) of the R shape may be set within a range from 1 to 4 mm, for example, but the size is not limited thereto and a size appropriate for a device configuration is determined in advance. Meanwhile, when the above-described state does not arise or when there is no special problem, a configuration without the R shape is also possible.

Shaft portions 69 are provided on both ends in the belt width direction W of the blade supporting member 64 and the shaft portions 69 are supported on a device casing not illustrated so as to be rotatable in a direction indicated by an arrow J.

With reference to FIG. 2 again, the extension spring 66 with one end connected to the blade supporting member 64 and the other end connected to the housing 67 applies tension F to rotate the blade supporting member 64 in a direction indicated by an arrow U around the shaft portion 69 to the blade supporting member 64. By the tension F, the cleaning blade 63 formed of the plate spring is positioned in a state in which the tip end 631 thereof abuts the surface of the intermediate transfer belt 21 and bends in a state of a cantilever with a supporting position by the blade supporting member 64 as a fulcrum, and the tip end 631 presses the surface of the intermediate transfer belt 21 by restoring force of the plate spring.

The tip end 631 of the cleaning blade 63 adheres tightly to the surface of the intermediate transfer belt 21 by pressing force by the cleaning blade 63 and the residual material on the intermediate transfer belt 21 is scrapped by the tip end 631 of the cleaning blade 63 to be removed.

Figure 5:
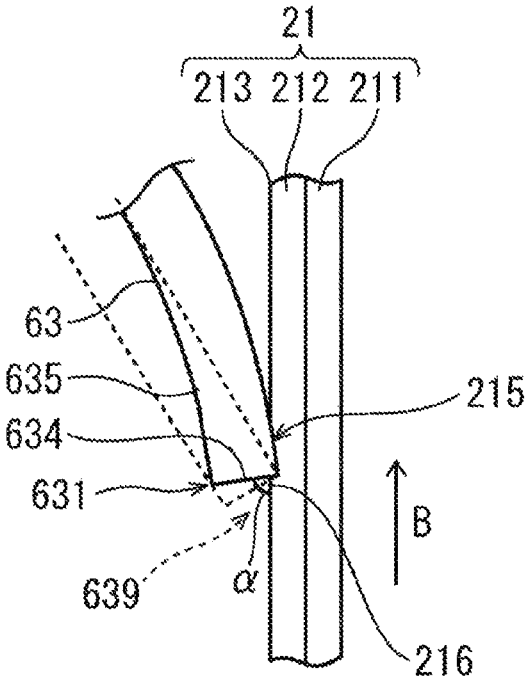
FIG. 5 is a schematic diagram of a state in which a tip end of the cleaning blade presses a surface of an intermediate transfer belt.

FIG. 5 is a schematic diagram illustrating a state in which the tip end 631 of the cleaning blade 63 presses the surface of the intermediate transfer belt 21. An example in this drawing is illustrated such that a cross-section of a central portion in the belt width direction W of the tip end 631 of the cleaning blade 63 is enlarged.

It is understood that the tip end 631 of the cleaning blade 63 bites into the surface of the intermediate transfer belt 21 a little by the pressing of the cleaning blade 63 to the intermediate transfer belt 21 and a hollow 215 is generated on the intermediate transfer belt 21 as illustrated in this drawing.

The intermediate transfer belt 21 includes a base layer 211, an elastic layer 212 stacked thereon, and a surface layer 213 stacked on the elastic layer 212.

Herein, the base layer 211 is made of resin such as PI and PPS, for example, and a thickness thereof may be set within a range from 50 to 100 μm, for example.

The elastic layer 212 is made of rubber such as NBR (nitrile rubber) and CR (chloroprene rubber), for example, and a thickness thereof may be set within a range from 100 to 500 μm, for example.

The surface layer 213 may be made of a material with higher hardness than that of the elastic layer 212, specifically, this may be an oxidized layer having a thickness of 5 to 20 μm and a coating layer made of fluorine resin having a thickness of 30 to 50 μm. An object of the surface layer 213 is to reduce tackiness and a configuration without the same is also possible when the tackiness is not especially problematic.

When a portion of the elastic layer 212 is mainly compressed by the pressing force from the tip end 631 of the cleaning blade 63, the hollow 215 is generated on the intermediate transfer belt 21, and the residual material on the intermediate transfer belt 21 is scrapped in the contact position (cleaning position) between the tip end 631 of the cleaning blade 63 and the surface of the intermediate transfer belt 21.

The abutting pressure of the cleaning blade 63 to the intermediate transfer belt 21 is preferably set such that a biting amount of the tip end 631 of the cleaning blade 63 into the intermediate transfer belt 21, that is to say, a depth of the hollow 215 becomes a predetermined value determined in advance as a value not smaller than belt surface roughness R, for example, 0.5 μm.

This is because, when the hollow 215 not smaller than the surface roughness R is generated, minute roughness on the surface of the intermediate transfer belt 21 is compressed to be deformed and is made flat by the pressing force of the tip end 631 of the cleaning blade 63, the adhesiveness to the surface of the intermediate transfer belt 21 is more easily increased, and a cleaning property may be further improved. Meanwhile, the surface roughness R may be set to a value obtained by arithmetic mean roughness (Ra), maximum height (Ry), ten-point mean height roughness (Rz) or the like, for example. The predetermined value of the biting amount may be determined to the value not smaller than the belt surface roughness R and a value within a range in which a situation that the abrasion of the surface of the intermediate transfer belt 21 progresses rapidly due to increased frictional force on the surface of the intermediate transfer belt 21 by the biting does not occur.

An end face 634 of the tip end 631 of the cleaning blade 63 is a flat surface and it is desirable that an angle α between the end face 634 of the tip end 631 and a surface portion 216 of the intermediate transfer belt 21 is 90 degrees or an angle within a predetermined range allowed in advance from 90 degrees (for example, ±5 degrees and the like) when the cleaning blade 63 bends in the state in which the tip end 631 of the cleaning blade 63 abuts the surface of the intermediate transfer belt 21.

This is because, when the cleaning blade 63 does not bend as indicated by a broken line, the angle α becomes significantly smaller than 90 degrees and a wedge-shaped space 639 is formed between the end face 634 and the surface portion of the intermediate transfer belt 21 (belt surface portion) 216.

Such wedge-shaped space 639 has a shape with which it is difficult that the residual material on the intermediate transfer belt 21 escapes outside the wedge-shaped space 639, that is to say, on a rear surface 635 side of the cleaning blade 63 due to its wedge shape, so that when the residual material is continuously accumulated in the wedge-shaped space 639 without dropping by gravity, this often gets stuck. In such a case, it often happens that the residual material accumulated in a deepest portion of the wedge-shaped space 639 downstream in the belt travel direction B is pushed by the residual material newly entering the wedge-shaped space 639 to pass through a clearance between the tip end 631 of the cleaning blade 63 and the surface of the intermediate transfer belt 21.

In contrast, when the cleaning blade 63 bends to a certain degree as indicated by a solid line, and the angle α becomes 90 degrees or close to this, the wedge-shaped space 639 is not formed and the residual material scrapped by the tip end 631 of the cleaning blade 63 on the intermediate transfer belt 21 easily escapes on the rear surface 635 side of the cleaning blade 63. The fact that the residual material easily escapes equals to the fact that the residual material is less likely to be accumulated in the tip end 631 of the cleaning blade 63, and it becomes possible to prevent deterioration in the cleaning property of the residual material.

It may be said that the belt surface portion 216 based on which the angle α is determined is a surface portion upstream of a portion in which the tip end 631 of the cleaning blade 63 abuts in the belt travel direction B and the vicinity thereof out of the surface of the intermediate transfer belt 21. Meanwhile, although the angle α may be obtained in advance by experiment and the like, there might be a case in which this does not affect the cleaning property depending on a device configuration, and in such a case, a configuration in which a range of the angle α is not especially set is also possible. It is also possible to make a shape of the end face 634 of the tip end 631 of the cleaning blade 63 a shape other than the flat surface.

Magnitude of the abutting pressure of the cleaning blade 63 to the surface of the intermediate transfer belt 21 is determined by the thickness of the cleaning blade 63, the tension of the extension spring 66 and the like.

That is to say, as the thickness of the cleaning blade 63 increases, rigidity of the cleaning blade 63 increases, so that the abutting pressure of the cleaning blade 63 becomes higher with the same bending amount and the surface of the intermediate transfer belt 21 formed of the elastic belt with lower hardness than that of metal such as stainless steel is easily worn.

On the other hand, as the thickness of the cleaning blade 63 decreases, the rigidity of the cleaning blade 63 decreases, and the abutting pressure of the cleaning blade 63 to the surface of the intermediate transfer belt 21 becomes lower with the same bending amount, so that a following property to change in the surface shape of the intermediate transfer belt 21 is improved and the abrasion of the surface of the intermediate transfer belt 21 may be prevented, but scrapping ability (removing ability) of the residual material on the intermediate transfer belt 21 are deteriorated.

Therefore, the thickness, the shape, the size, and the material of the cleaning blade 63, the tension of the extension spring 66, the amount of the play of the cleaning blade 63, the material of the elastic layer of the intermediate transfer belt 21 and the like are determined by experiment and the like in advance in order to inhibit the abrasion of the surface of the intermediate transfer belt 21 while securing the removing ability of the residual material on the intermediate transfer belt 21.

(3) Configuration of Steering Unit 70

Figure 6:
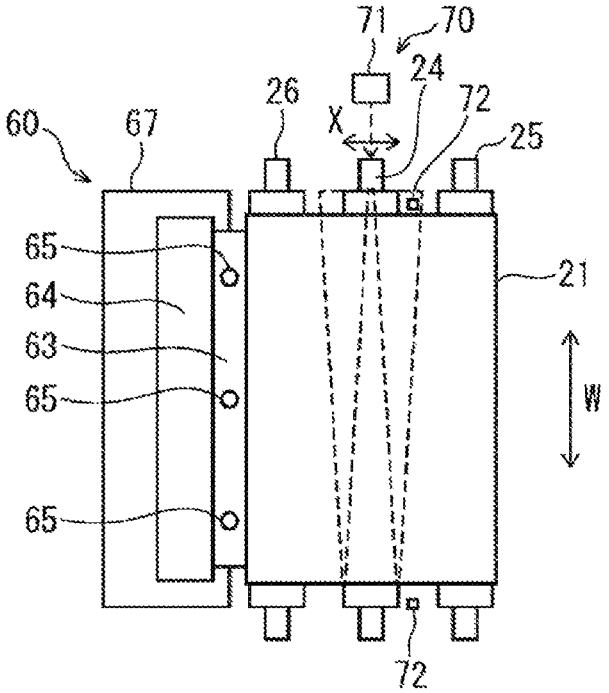
FIG. 6 is a plane view for illustrating a configuration of a steering unit.

FIG. 6 is a plane view for illustrating a configuration of the steering unit 70 in which only members required for illustration are illustrated.

As illustrated in the drawing, the steering unit 70 provided with a steering driving unit 71 and a belt meandering detecting sensor 72 corrects meandering of the intermediate transfer belt 21.

The belt meandering detecting sensors 72 are provided on both sides in the belt width direction W across the intermediate transfer belt 21. One belt meandering detecting sensor 72 detects positional displacement when the intermediate transfer belt 21 steps to one side in the belt width direction W by the meandering to displace from a reference position and the other belt meandering detecting sensor 72 detects the positional displacement when the position in the belt width direction W of the intermediate transfer belt 21 steps to the other side by the meandering to displace from the reference position. A reflective optical sensor and the like is used, for example, as the belt meandering detecting sensor 72 and a detection signal thereof is sent to the steering driving unit 71.

When the steering driving unit 71 receives a positional displacement detection signal from the belt meandering detecting sensor 72, this determines that the intermediate transfer belt 21 meanders and performs steering control to change inclination in an axial direction of the driven roller 24 on which the intermediate transfer belt 21 is stretched such that one end is fixed and the other end is moved in a direction indicated by an arrow X as indicated by a broken line, for example, in order to prevent the meandering.

Since the inclination in the axial direction of the driven roller 24 is changed, difference arises in the tension of the intermediate transfer belt 21 in the belt width direction W (roller axial direction), and it is possible to return the position in the belt width direction W of the intermediate transfer belt 21 stepping to either side in the belt width direction W by the meandering to its original reference position.

Although the meandering of the intermediate transfer belt 21 may be corrected by the above-described steering control, the intermediate transfer belt 21 is in a state in which the difference in the belt width direction W arises in the tension thereof, so that the flapping easily occurs in the belt width direction W on the intermediate transfer belt 21 though this is minute.

However, even when the flapping occurs on the intermediate transfer belt 21 by the steering control, the cleaning blade 63 of the plate spring is configured to be freely supported, the following property of the cleaning blade 63 to the change in the surface shape of the intermediate transfer belt 21 by the flapping is excellent as described above, so that deterioration in the adhesiveness between the tip end 631 of the cleaning blade 63 and the surface of the intermediate transfer belt 21 is inhibited and the deterioration in the cleaning property of the residual material is prevented. An experimental result to be described next proves that the deterioration in the cleaning property of the residual material is prevented.

(4) Regarding Experimental Result by Example

A result of fabricating an experimental device set in a following manner to evaluate driving torque, color shift, the cleaning property and the like of the intermediate transfer belt 21 is described as one example.

As the intermediate transfer belt 21, an elastic belt having volume resistivity of $1\times10^8$ Ω·cm obtained by forming a 250 μm thick elastic layer made of an NBR rubber material on a 80 μm thick base layer made of PI and hardening the surface layer above them was used. This is hereinafter referred to as an elastic belt 21*a*.

The cleaning blade 63 was made of stainless steel (SUS material) having a plate thickness of 0.09 mm. The cleaning blade 63 was supported as a cantilever configuration such that the tip end 631 side has a free length of 10 mm with the base end 630 side as the fulcrum, and a load of 10 N was applied to the cleaning blade 63 by the extension spring 66. The cleaning blade 63 having this configuration is hereinafter referred to as a metallic blade 63*a*.

Figure 7:
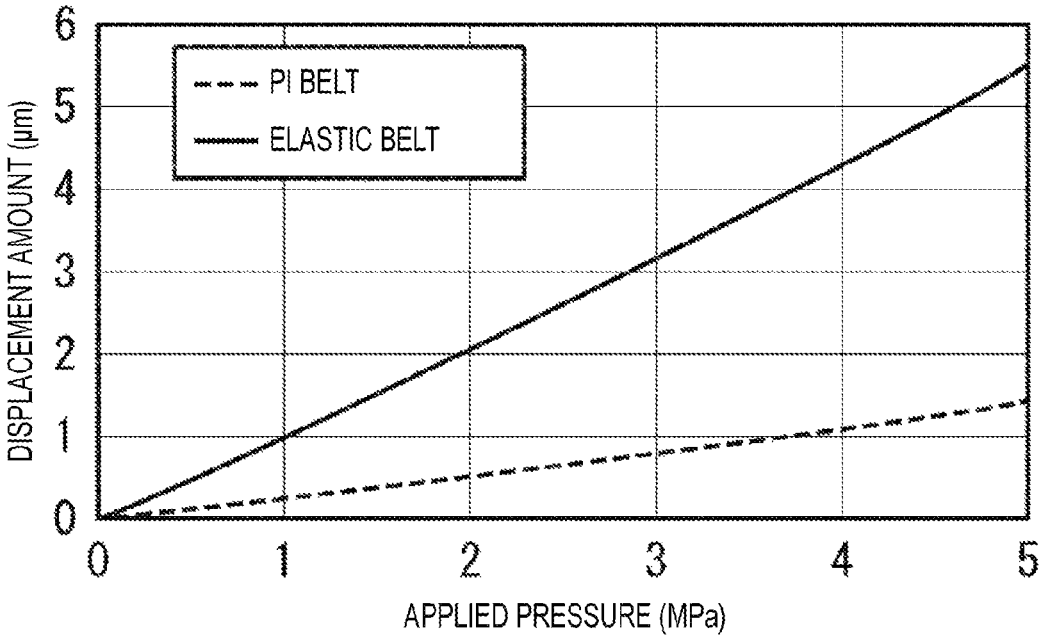
FIG. 7 is a view illustrating a relationship between applied pressure to an elastic belt and a displacement amount.

FIG. 7 is a view illustrating a relationship between applied pressure to the elastic belt 21*a* and a displacement amount, and a PI belt made of PI without the elastic layer is also illustrated as a comparative example. The relationship between the applied pressure and the displacement amount is that of a result of a minute compression test by means of a minute hardness meter DUH-W201S manufactured by Shimadzu Corporation. As illustrated in this drawing, it is understood that the elastic belt 21*a* has a larger compression displacement amount with the same load than that of the PI belt.

A mean pressure of approximately 0.5 MPa was obtained as the applied pressure to the elastic belt 21*a* by the above-described setting of the metallic blade 63*a* and the elastic belt 21*a* was compression-deformed by approximately 0.5 μm as the displacement amount.

As a result of the experiment to clean the toner images of respective colors (adhering amount=16 g/m$^2$) obtained by primarily transferring solid images of four colors with a toner adhering amount of each color of 4 g/m$^2$ in an overlapping manner to the intermediate transfer belt 21 under a low-humidity environment by the developing agent in an initial state (corresponding to a brand-new one) in which a charge amount is maximum by means of the metallic blade 63*a* under a condition that they are not secondarily transferred in the experimental device, an excellent cleaning property could be visibly confirmed.

Figure 8:
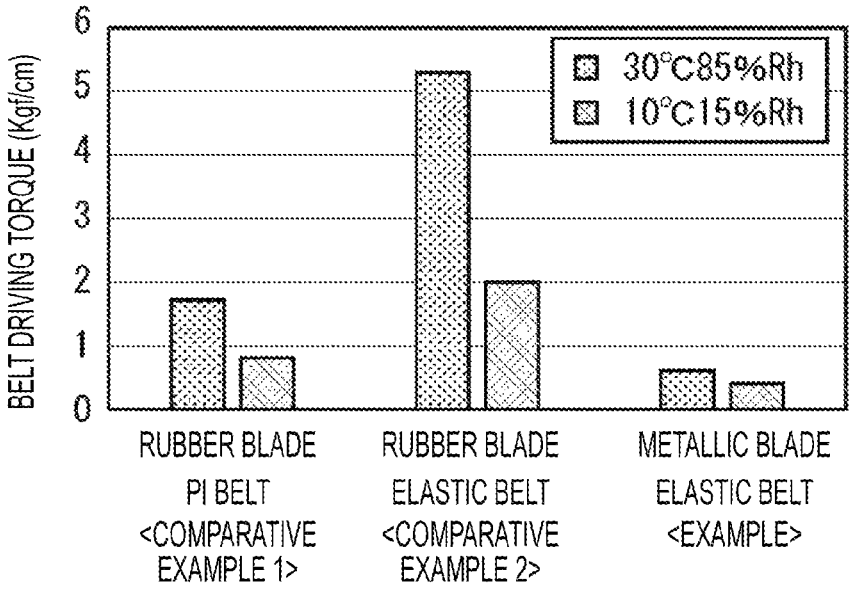
FIG. 8 is a view illustrating difference in driving torque of the elastic belt when the blade abuts the elastic belt and when this does not abut.

FIG. 8 is a view illustrating difference in the driving torque of the elastic belt 21*a* of a case in which the metallic blade 63*a* abuts the elastic belt 21*a* and a case in which this does not abut, and the difference in the driving torque in each of a comparative example 1 of a case in which a urethane rubber blade abuts the PI belt and a comparative example 2 of a case in which the urethane rubber blade abuts the elastic belt 21*a* is also illustrated for comparison. Meanwhile, the measurement was performed under each of a 10° C.15% RH environment (LL environment) and a 30° C.85% RH environment (HH environment).

From this drawing, it is understood that the difference in the belt driving torque is the smallest in the example and the largest in the comparative example 2 under all the environments.

It is considered that, since the comparative example 2 is a combination of the elastic belt 21*a* and the urethane rubber blade, in other words, both members are the elastic bodies, a real contact area is the largest to be a large brake to the belt driving and the difference in the belt driving torque is the largest. It is considered that the hardness of the elastic body being the urethane rubber being the material of the blade changes with temperature change and the frictional force generated between them varies, so that the difference between the LL environment and the HH environment (hereinafter, referred to as "difference in driving torque due to environment change) becomes the largest.

It is considered that the difference in the driving torque by the environment change becomes vanishingly small because the metallic blade 63*a* is used in the example, so that the difference in the belt driving torque is significantly smaller than that of the comparative example 2 and the change in the hardness by the temperature change is smaller than that of the rubber being the elastic body.

On the other hand, it is considered that the difference in the driving torque by the environment change is smaller than that of the comparative example 2 and larger than that of the example because the belt is the PI belt without the elastic layer though the rubber blade being the elastic body is used in the comparative example 1.

As the difference in the driving torque by the environment change becomes larger, a peripheral speed of the intermediate transfer belt easily varies according to the environment change, so that the color shift among the respective colors easily occurs.

Figure 9:
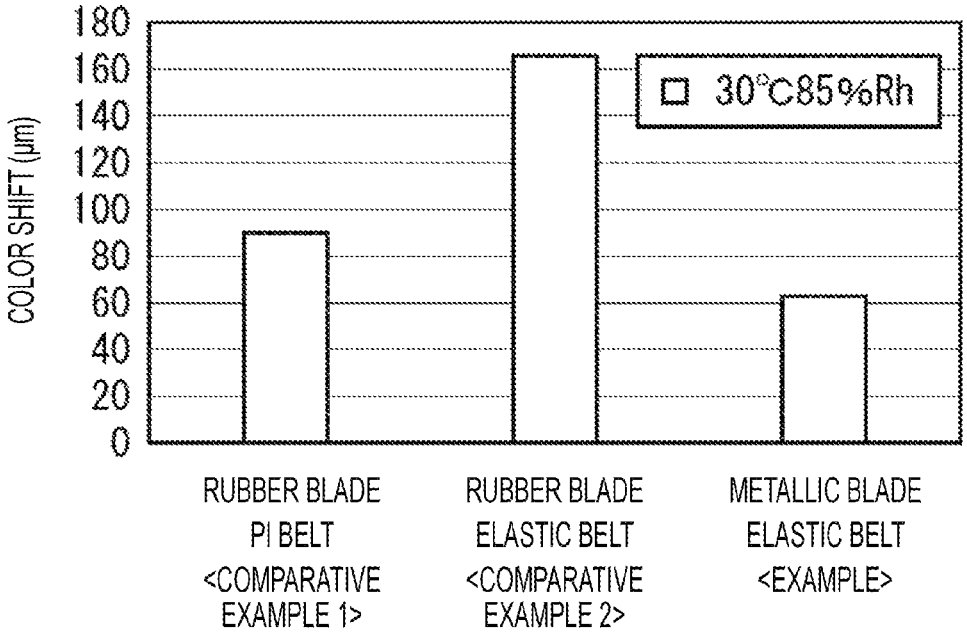
FIG. 9 is a view illustrating an experimental result of color shift in comparative examples 1 and 2 and an example.

FIG. 9 is a view illustrating an experimental result of the color shift in the comparative examples 1 and 2 and the example.

Herein, a mean value of a color shift amount in a sub scanning direction of the Y-color toner image with respect to the K-color toner image in a case in which a rudder pattern chart formed of the toner images of four colors is printed by the experimental device in which the intermediate transfer belt and the cleaning blade are arranged is illustrated in each example. Printing was performed under the 30° C.85% RH environment in which the difference in the belt driving torque becomes large.

The color shift amount was measured by a method of detecting the rudder patterns of respective colors primarily transferred on the intermediate transfer belt by an optical sensor (not illustrated), obtaining a distance in the sub scanning direction (corresponding to the belt travel direction) to the Y-color pattern based on the K-color pattern from a detection result, and making difference between the obtained distance and an original value the color shift amount.

As illustrated in this drawing, it was understood that the color shift amount is smaller in the example than in the comparative examples 1 and 2, and it was proved that the configuration of the example was effective in reducing occurrence of the color shift due to the variation of the driving torque of the intermediate transfer belt as compared to the configurations of the comparative examples.

Figures 10, 11:
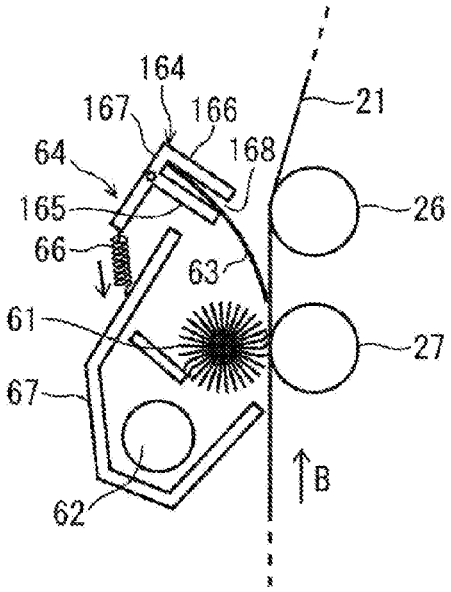
FIG. 10 is a view illustrating a result of evaluating a cleaning property when steering control is performed for each of two configuration examples.
FIG. 11 is a view illustrating a variation of a supporting mechanism of a cleaning blade.

FIG. 10 is a view illustrating a result of evaluating the cleaning property when the steering control is performed for each of the two configuration examples.

Metallic blade fixation in a configuration example 1 is intended to mean a configuration in which a blade made of SUS having a thickness of 0.08 mm is interposed between two steel plates having a thickness of 1.6 mm in a state in which a free length is 10 mm to be screwed at three points at an interval in the belt width direction W.

Metallic blade non-fixation in a configuration example 2 is intended to mean a configuration in which a blade made of SUS having a thickness of 0.08 mm is inserted into a C-shaped portion of a supporting member obtained by forming a steel plate having a thickness of 1.6 mm to have the C-shape in cross section and the blade is supported in a manner that a blade tip end projects by 10 mm from the steel plate (with a free length of 10 mm).

The configuration example 2 corresponds to the configuration of a variation illustrated in FIG. 11 and a supporting unit 164 formed of supporting pieces 165, 166, and 167 forms the C-shaped portion. It is configured that the cleaning blade 63 is inserted into a clearance 168 between the opposing supporting pieces 165 and 166. The cleaning blade 63 is supported on the blade supporting member 64 in a state in which the base end thereof only abuts the supporting piece 167 in a deepest portion of the C-shape, and this may substantially be said to be a free supporting mechanism having the backlash as in the configuration illustrated in FIG. 2.

With reference to FIG. 10 again, loads 35N, 45N, 55N, and 65N are spring loads when the secondary transfer roller 29 is pressed against the driving roller 22.

In this experiment, energizing force of a compression spring on one end side is fixed to 30N and the energizing force of the compression spring on the other end is switched to 35N, 45N, 55N, and 65N, so that difference in pressure in an axial direction in secondary transfer nip is provided and force to allow the intermediate transfer belt 21 to meander is exerted, and the cleaning property when the flapping occurs on the intermediate transfer belt 21 when the steering control is executed by the meandering is confirmed.

As the energizing force of the compression spring on the other end becomes larger, the meandering becomes larger, and as the meandering becomes larger, it becomes necessary to further incline the driven roller 24 for correcting the same. As the inclination of the driven roller 24 becomes larger, a degree of the flapping occurring on the intermediate transfer belt 21 (difference in height between a peak and a trough) becomes larger, so that the cleaning property is more likely to be deteriorated. When the flapping occurs by correction of the meandering, one end side in the belt width direction W of the intermediate transfer belt 21 is often put into a flapping state and the other end side is often put into a stretched state to a certain degree.

The cleaning property was evaluated by performing an experiment to sequentially form 10 pages of the toner images, each of which is obtained by overlapping full-screen solid images having a size corresponding to an A3 size of Y color and M color with the toner adhering amount of 4 g/m$^2$ each in the low-wet environment, one by one on the intermediate transfer belt 21 and clean the toner images by the metallic blade 63*a* under a condition that they are not secondarily transferred, and visually observing occurrence of the cleaning trouble.

Representation in this drawing indicates the number of sheets on which cleaning trouble occurs and a degree thereof.

In the configuration 2, the metallic blade is not fixed.

Therefore, when this abuts the peak out of the peaks and troughs of the flapping occurring on one end side in the belt width direction W of the intermediate transfer belt, one end side of the metallic blade retracts in a direction away from the intermediate transfer belt within the range of the play and the abutting pressure on one end side is inhibited from becoming excessive. On the other hand, when this abuts the trough, the one end side of the metallic blade advances in a direction approaching the intermediate transfer belt within the range of the play by an action of the restoring force of the plate spring and the abutting pressure on one end side is inhibited from becoming too small. That is to say, the following property to the change in the shape of the intermediate transfer belt due to the flapping becomes excellent.

According to this, even when the deviation of the abutting pressure distribution (biased load) of the metallic blade to the intermediate transfer belt surface is to arise in the belt width direction W, force acting in a portion on a side on which the abutting pressure is to become larger of the metallic blade escapes by the amount of the play. Therefore, the abutting pressure is less likely to become large on one end side and become small on the other end side in the belt width direction W and a uniform state in the belt width direction W is easily maintained. That is to say, the adhesiveness between the metallic blade and the intermediate transfer belt surface is easily maintained. Decrease in the pressing force by the compression deformation as in the rubber blade does not occur.

According to them, in the configuration 2, it is considered that a sufficient cleaning property is maintained in any of the case with 35N in which the energizing force of the compression spring is the smallest to the case with 65N in which this is the largest.

Furthermore, the state in which the deviation of the abutting pressure distribution arises is less likely to be continued, so that rapid abrasion of the intermediate transfer belt surface by the metallic blade is prevented.

On the other hand, it is understood that the cleaning property is high in the cases in which the energizing force of the compression spring is 35N and 45N but the cleaning property is deteriorated in the cases of 55N and 65N as compared to the cases of 35N and 45N in the configuration 1. This is because the metallic blade is used but fixedly supported in the configuration 1 and the following property with respect to the flapping of the intermediate transfer belt is not more excellent than that of the configuration 2 in which this is not fixedly supported, so that the cleaning property is deteriorated a little as compared to the configuration 2.

Spring load difference is designed to be ±20% in a product specification, and an excellent cleaning property is secured also under the steering control as shown in the results of 45N or lower for both the configurations 1 and 2, but it may be said that the configuration 2 is a system with larger allowability.

Since improvement in the cleaning property is obtained by the excellent following property of the cleaning blade 63 to the change in shape of the intermediate transfer belt 21, it is also possible to obtain an effect of improving the cleaning property and an effect of preventing the rapid abrasion as in the above-described manner not only in a case of the flapping occurring by the steering control for preventing the meandering but also in a case in which a flapping phenomenon is naturally generated and a case in which the surface of the intermediate transfer belt 21 is not completely flat but slightly deformed, for example.

As described above, in this embodiment, since the intermediate transfer belt 21 includes the elastic layer 212, the adhesiveness between the intermediate transfer belt 21 and the recording sheet is improved and a transfer property may be improved, and since the cleaning blade 63 is made of metal, the frictional force between the same and the intermediate transfer belt 21 may be decreased as compared to that of the elastic body such as rubber, so that it becomes possible to inhibit the rapid abrasion of the cleaning blade 63 and inhibit the color shift even when the environment variation occurs in the case of the color image formation.

Since the cleaning blade 63 is formed of the plate spring, this bends following the change in the surface shape of the intermediate transfer belt 21 by the restoring force of the plate spring in the state in which the tip end 631 of the cleaning blade 63 abuts the surface of the intermediate transfer belt 21 and the adhesiveness to the intermediate transfer belt 21 is increased, so that the residual material on the intermediate transfer belt 21 may be effectively removed.

If it is configured that a metallic blade tip end of a rigid body which is not the plate spring is pressed against the surface of the intermediate transfer belt 21, the rigid metallic blade alone cannot follow the change in the surface shape of the intermediate transfer belt 21. Therefore, the abutting pressure between the blade tip end and the surface of the intermediate transfer belt 21 easily varies and the cleaning property is deteriorated, or if the blade tip end is strongly pressed against the intermediate transfer belt 21 in advance for maintaining the cleaning property, the surface of the intermediate transfer belt 21 is easily worn. On the other hand, if the cleaning blade 63 is formed of the plate spring as in this embodiment, the deterioration in the cleaning property may be inhibited and it is possible to inhibit the abrasion of the surface of the intermediate transfer belt 21.

<Variation>

Although the present invention is described above based on the embodiment, it goes without saying that the present invention is not limited to the above-described embodiment and a following variation is also possible.

(1) Although a cleaning position in which a tip end 631 of a cleaning blade 63 abuts a surface of an intermediate transfer belt 21 is located in a position between driven rollers 26 and 27 adjacent to each other at an interval in a belt travel direction B, that is to say, a position in which a member (backup member) such as a roller does not exist on an opposite side with the intermediate transfer belt 21 interposed therebetween in the above-described embodiment, there is no limitation.

For example, a configuration in which a position opposed to the driven roller 26 with the intermediate transfer belt 21 interposed therebetween is made the cleaning position is also possible. In this configuration, the intermediate transfer belt 21 is interposed between the tip end 631 of the cleaning blade 63 on a surface side and the driven roller 26 as the backup member on a rear surface side in the cleaning position to be supported from both the surface side and the rear surface side, so that pressing force from the tip end 631 of the cleaning blade 63 easily acts on a surface of the intermediate transfer belt 21 and scrapping ability of a residual material may be improved.

On the other hand, since the scrapping ability by the cleaning blade 63 is improved, it is supposed that abutting pressure of the cleaning blade 63 to the surface of the intermediate transfer belt 21 becomes stronger and abrasion of the surface of the intermediate transfer belt 21 easily progresses. Therefore, it is desirable to determine the cleaning position in an appropriate position after comparing and considering both a cleaning property and a lifetime of the intermediate transfer belt 21.

(2) Although a counter type configuration example in which the tip end 631 of the cleaning blade 63 abuts the surface of the intermediate transfer belt 21 in a direction opposite to a belt travel direction B (moving direction of the intermediate transfer belt 21) is described in the above-described embodiment, there is no limitation. For example, a configuration in which the tip end 631 of the cleaning blade 63 abuts the surface of the intermediate transfer belt 21 in a perpendicular direction, a configuration in which this abuts the same in the same direction as the belt travel direction B and the like are also possible.

Although it is configured to hold a blade supporting member 64 which supports the cleaning blade 63 so as to be rotatable around a shaft portion 69 parallel to the belt width direction W and apply tension of an extension spring 66 to the blade supporting member 64 as energizing force, thereby applying force in a direction in which the cleaning blade 63 is pressed against the surface of the intermediate transfer belt 21, there is no limitation. For example, there may be a configuration of holding the blade supporting member 64 so as to be slidable in a separating/approaching direction with respect to the intermediate transfer belt 21 to apply the energizing force in a direction approaching the intermediate transfer belt 21 to the blade supporting member 64. A member which applies the energizing force is not limited to the extension spring 66 and an energizing member such as another elastic body may also be used.

(3) Although a configuration example in which a base end 630 of the cleaning blade 63 being a metallic thin plate spring is supported on the blade supporting member 64 in a state with play with respect to the intermediate transfer belt 21 (freely supported state) is described in the above-described embodiment, there is no limitation. Since frictional force between the intermediate transfer belt 21 including an elastic layer and the cleaning blade 63 formed of the metallic plate spring may be decreased and color shift may be inhibited by combination of them, it is also possible to configure such that the cleaning blade 63 is fixedly supported without the play.

(4) Although an example in which an image forming device according to the present invention is applied to a tandem color printer is described in the above-described embodiment, there is no limitation. This may be applied to a general image forming device such as a copier, a fax, a multiple function peripheral (MFP) and the like, for example, with a configuration of transferring a toner image formed on a rotating image carrier to a transferred body and removing a residual material on the image carrier after the transfer by the cleaning blade regardless of whether a function is to execute color image formation or to execute monochrome image formation.

The image carrier may be an intermediate transfer body including the intermediate transfer belt 21 and an intermediate transfer drum in an intermediate transfer system or a photoreceptor belt. In a case of the intermediate transfer system, the intermediate transfer body may be considered as the image carrier and a recording sheet may be considered as the transferred body. When the photoreceptor belt is used as the image carrier, the intermediate transfer body may be considered as the transferred body in a case of the intermediate transfer system and otherwise the recording sheet may be considered as the transferred body.

In a configuration of transferring the toner image to a first intermediate transfer body to another second intermediate transfer body and thereafter transferring the toner image on the second intermediate transfer body to the recording sheet, for example, the first intermediate transfer body may be considered as the image carrier and the second intermediate transfer body may be considered as the transferred body.

Although it is configured that the image carrier includes a base layer, the elastic layer, and a surface layer, there is no limitation and it is sufficient that this includes at least the elastic layer. Furthermore, it is also possible to apply to a configuration in which steering control described above is not performed, and when a required cleaning property may be secured, a configuration without a cleaning roller 61 is also possible.

Furthermore, it goes without saying that a material, a size, and a shape of each member described above and various numerical values are not limited to above-described ones and appropriate material and size are determined according to the device configuration.

It is also possible to combine contents of the above-described embodiment and the above-described variation.

The present invention may be applied to an image forming device which removes a residual material on an image carrier by a cleaning blade.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image carrier on which a toner image is formed; and a cleaning blade which removes a residual material on the image carrier after the toner image is transferred to a transferred body, wherein the image carrier includes an elastic layer, the cleaning blade is made of metal, and a tip end of the cleaning blade is made of metal and is pressed against the image carrier by restoring force of the cleaning blade.

2. The image forming device according to claim 1, comprising a supporting member which supports the cleaning blade with play with respect to the image carrier.

3. The image forming device according to claim 2, further comprising an energizing member which applies force in a direction to press the cleaning blade against the image carrier to the supporting member.

4. The image forming device according to claim 1, wherein abutting pressure of the cleaning blade to the image carrier is set such that a biting amount of a tip end of the cleaning blade into a surface of the image carrier becomes a predetermined value.

5. The image forming device according to claim 4, wherein the predetermined value is a value determined in advance as a value not smaller than surface roughness of the image carrier.

6. The image forming device according to claim 1, wherein the cleaning blade is arranged such that the tip end is in a counter direction relative to a moving direction of the image carrier, an end face of the tip end is a flat surface, and an angle between the end face of the tip end of the cleaning blade and a surface portion of the image carrier is a right angle or an angle within an allowable range from the right angle.

7. The image forming device according to claim 1, wherein the cleaning blade is elongated in a width direction orthogonal to a moving direction of the image carrier, and corner portions on both ends in the width direction on the tip end are formed to have an R shape.

8. The image forming device according to claim 1, wherein the image carrier further includes a base layer and a surface layer which the cleaning blade abuts arranged on a side opposite to the base layer across the elastic layer, and the surface layer is formed of a material with higher hardness than the hardness of the elastic layer.

9. The image forming device according to claim 1, comprising:

an image forming unit which forms toner images of different colors on each of a plurality of photoreceptors; and an intermediate transfer body to which the toner images of respective colors formed on the plurality of photoreceptors are multi-transferred, wherein the image carrier is the intermediate transfer body, and the transferred body is a recording sheet to which the toner images of respective colors multi-transferred to the intermediate transfer body are transferred.

10. The image forming device according to claim 1, wherein the elastic layer has rubber elasticity.

11. The image forming device according to claim 1, wherein a thickness of the elastic layer is within a range of 100 to 500 μm.

* * * * *